US010197947B2

(12) United States Patent
Sunayama

(10) Patent No.: US 10,197,947 B2
(45) Date of Patent: Feb. 5, 2019

(54) IMAGE FORMING APPARATUS

(71) Applicant: KYOCERA Document Solutions Inc., Osaka (JP)

(72) Inventor: Satoshi Sunayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/894,639

(22) Filed: Feb. 12, 2018

(65) Prior Publication Data

US 2018/0284651 A1 Oct. 4, 2018

(30) Foreign Application Priority Data

Mar. 28, 2017 (JP) ..... 2017-062904

(51) Int. Cl.
*G03G 15/08* (2006.01)

(52) U.S. Cl.
CPC ..... *G03G 15/0898* (2013.01); *G03G 15/0865* (2013.01); *G03G 15/0891* (2013.01)

(58) Field of Classification Search
CPC ..... G03G 15/0898; G03G 15/0865; G03G 15/0887
See application file for complete search history.

(56) References Cited

U.S. PATENT DOCUMENTS 9,639,024 B2 * 5/2017 Tauchi ..... G03G 15/081
2010/0247164 A1 * 9/2010 Shigehiro ..... G03G 15/0815 399/271
2011/0229184 A1 * 9/2011 Kashimoto ..... G03G 15/0896 399/92
2012/0201575 A1 * 8/2012 Kashimoto ..... G03G 15/0812 399/272

FOREIGN PATENT DOCUMENTS

JP 2003-255788 A 9/2003

* cited by examiner

*Primary Examiner* — Carla J Therrien
(74) *Attorney, Agent, or Firm* — Studebaker & Brackett PC

(57) ABSTRACT

An image forming apparatus includes an image carrier, a developing device, a detecting device and a vibration imparting device. The image carrier rotates around an axis. The developing device includes a developing member rotating around an axis at a position facing the image carrier and supplying a toner to the image carrier. The detecting device detects a number of the toner scattered from an inside to an outside of the developing device. The vibration imparting device imparts vibration to the toner accumulated near the developing member when the number of the toner detected by the detecting device satisfies a predetermined condition.

6 Claims, 8 Drawing Sheets

IMAGE FORMING APPARATUS

INCORPORATION BY REFERENCE

This application is based on and claims the benefit of priority from Japanese Patent application No. 2017-062904 filed on Mar. 28, 2017, which is incorporated by reference in its entirety.

BACKGROUND

The present disclosure relates to an image forming apparatus.

An electrophotographic type image forming apparatus includes a developing device which develops an electrostatic latent image on an image carrier (a photosensitive drum) to a toner image. In such an image forming apparatus, a toner stored in the developing device may be scattered outside the developing device through a portion facing the photosensitive drum.

The image forming apparatus may include a suction fan which sucks in the toner scattered from the developing device into a development duct with air flow. The development duct is provided with a dust sensor for detecting an amount of dust. The dust sensor can detect an amount of the scattered toner flowing in the development duct. Therefore, the dust sensor can stably detect an amount of the scattered toner compared with a case where an amount of a floating toner is detected.

By the way, in the developing device, the toner accumulated on an inner face of a housing of the developing device is mainly scattered. The dust sensor can stably detect an amount of the scattered toner, however, it is impossible to prevent the toner from being accumulated on the housing of the developing device. That is, it is impossible to reduce an amount (a number) of the scattered toner.

SUMMARY

In accordance with an aspect of the present disclosure, an image forming apparatus includes an image carrier, a developing device, a detecting device and a vibration imparting device. The image carrier rotates around an axis. The developing device includes a developing member rotating around an axis at a position facing the image carrier and supplying a toner to the image carrier. The detecting device detects a number of the toner scattered from an inside to an outside of the developing device. The vibration imparting device imparts vibration to the toner accumulated near the developing member when the number of the toner detected by the detecting device satisfies a predetermined condition.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, one embodiment of the present disclosure will be described. In the following figures, Fr, Rr, L, R, U and D respectively indicate a front side, a rear side, a left side, a right side, an upper side and a down side.

Figure 1:
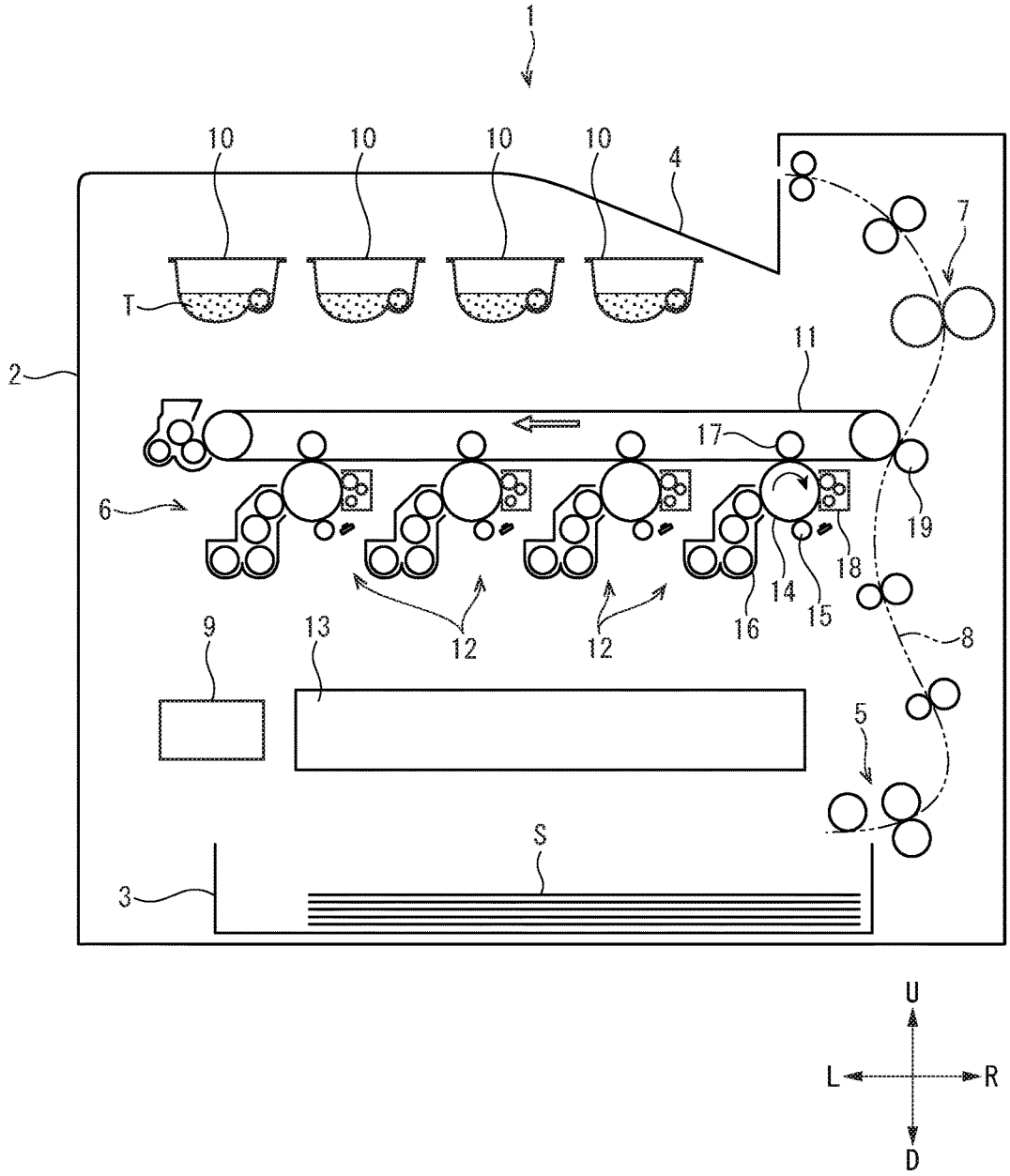
FIG. 1 is a sectional view schematically showing an inner structure of a color printer according to one embodiment of the present disclosure.

<An outline of a color printer> With reference to FIG. 1, an entire structure of a color printer 1 as an image forming apparatus will be described. FIG. 1 is a sectional view schematically showing an inner structure of the color printer 1.

The color printer 1 includes an apparatus main body 2 constituting an approximate parallelepiped appearance of the color printer 1. In a lower portion of the apparatus main body 2, a sheet feeding cassette 3 storing a paper sheet S (a bundle of the sheets) is detachably attached. On an upper face of the apparatus main body 2, an ejected sheet tray 4 is provided. The sheet S is not limited to the paper sheet, and may include a resin sheet or the like.

The color printer 1 includes a sheet feeding device 5, an image forming device 6 and a fixing device 7 which are provided in the apparatus main body 2. The sheet feeding device 5 is provided at an upstream end portion of a conveying path 8 extending from the sheet feeding cassette 3 to the ejected sheet tray 4. The fixing device 7 is provided at a downstream side of the conveying path 8. The image forming device 6 is provided on the conveying path 8 between the sheet feeding device 5 and the fixing device 7.

The image forming device 6 includes four toner containers 10, an intermediate transferring belt 11, four drum units 12 and an optical scanning device 13. The intermediate transferring belt 11 rotates in a direction shown by an arrow in FIG. 1. The four toner containers 10 store developer containing toner T of corresponding colors (yellow, magenta, cyan or black). The developer is a two-component developer containing the toner T and a carrier, for example. Each drum unit 12 includes a photosensitive drum 14, a charging device 15, a developing device 16, a primary transferring roller 17 and a cleaning device 18. Each photosensitive drum 14 is formed in a cylindrical shape elongated in the front-and-rear direction, and rotates around an axis. Each primary transferring roller 17 faces the photosensitive drum 14 via the intermediate transferring belt 11. A secondary transferring roller 19 comes into contact with a rear portion of the intermediate transferring belt 11 to form a transferring nip.

A control device 9 of the color printer 1 suitably controls each device to execute the following image forming process. Each charging device 15 charges a surface of each photosensitive drum 14. Each photosensitive drum 14 is emitted with scanning light from the optical scanning device 13 to carry an electrostatic latent image. Each developing device 16 develops the electrostatic latent image on the photosensitive drum 14 into a toner image using the toner T supplied from the toner container 10. Each primary transferring roller 17 primarily transfers the toner image on the photosensitive drum 14 to the rotating intermediate transferring belt 11. The intermediate transferring belt 11 rotates so as to overlap the four color toner images and to carry a full color toner image. The sheet S is fed from the sheet feeding cassette 3 by the sheet feeding device 5 to the conveying path 8. The secondary transferring roller 19 secondarily transfers the toner image on the intermediate transferring belt 11 to the sheet S passing through the transferring nip. The fixing device 7 heats the toner image to fix it on the sheet S. Then, the sheet S is ejected on the ejected sheet tray 4. Each cleaning device 18 removes the toner T remained on the photosensitive drum 14.

By the way, each developing device 16 stores the developer supplied from the toner container 10. The toner T contained in the developer may be scattered inside the apparatus main body 2 through a portion facing the photosensitive drum 14. The color printer 1 according to the present embodiment includes a scattering prevention structure 30 configured to reduce an amount the toner T scattered from the developing device 16.

Figure 2:
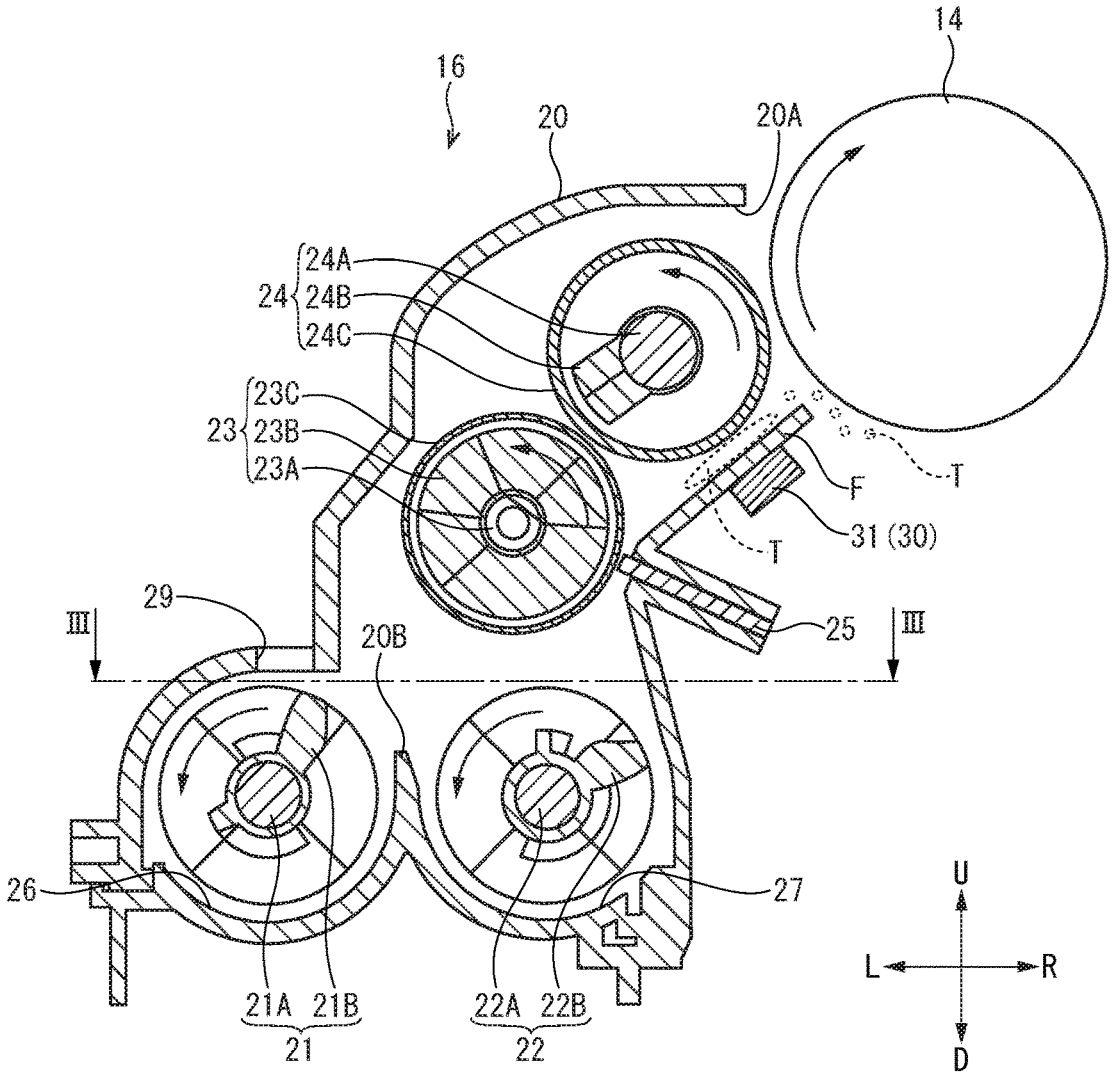
FIG. 2 is a sectional view schematically showing an inner structure of a developing device according to one embodiment of the present disclosure.
Figure 3:
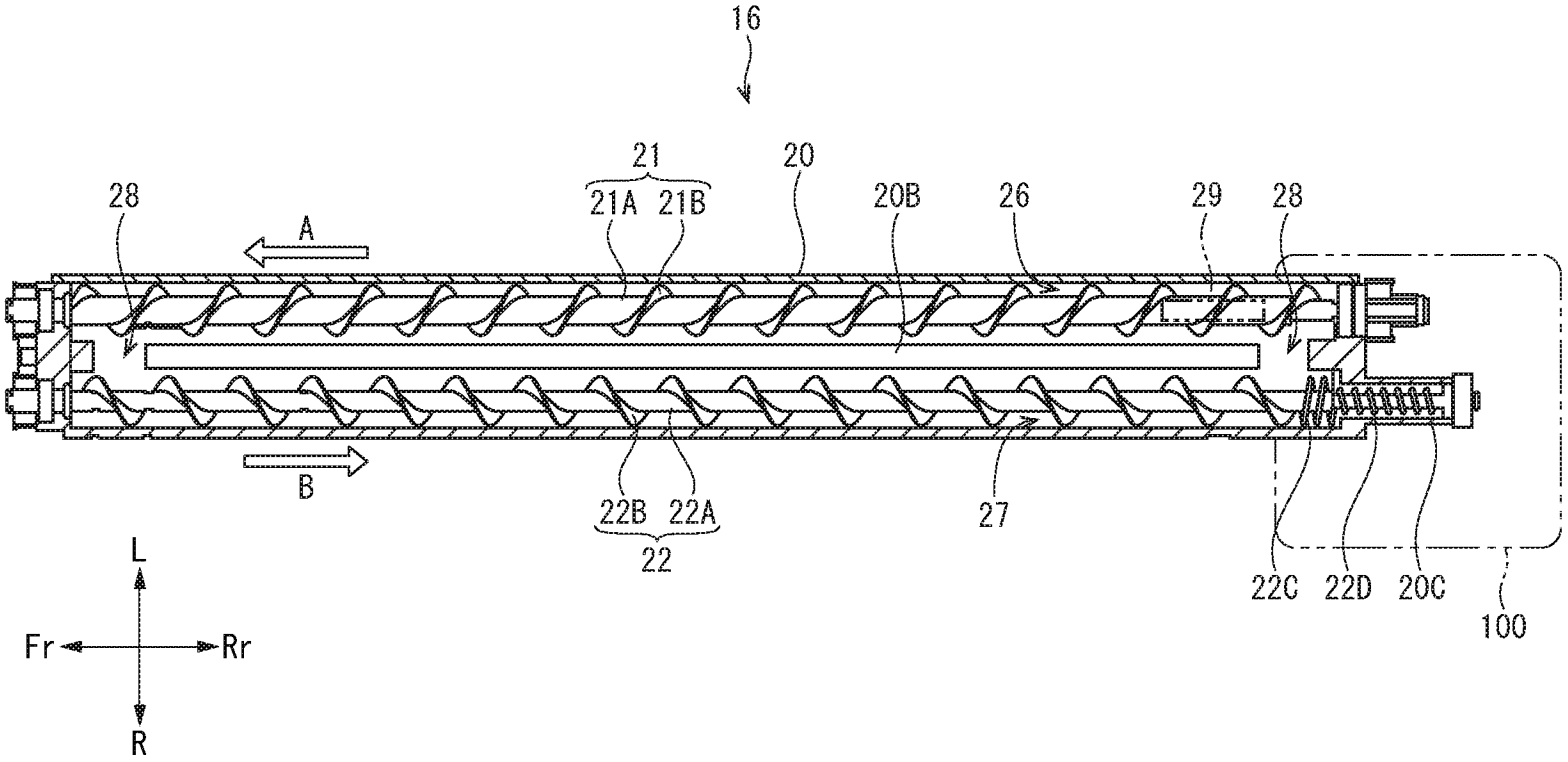
FIG. 3 is a sectional view along a III-III line of FIG. 2.

<A structure of the developing device> With reference to FIG. 2 and FIG. 3, each developing device 16 will be described. FIG. 2 is a sectional view schematically showing an inner structure of the developing device 16. FIG. 3 is a sectional view along a III-III line of FIG. 2. The four developing devices 16 have almost the same structure, and one of the developing devices 16 will be thus described below.

As shown in FIG. 2, the developing device 16 includes a housing 20, first and second agitating screws 21 and 22, a magnetic roller 23, a developing roller 24 and a blade 25. The housing 20 stores the developer containing the toner T. The first and second agitating screws 21 and 22 agitate the developer stored in the housing 20. The magnetic roller 23 as an example of a magnetic member draws up the developer stored in the housing 20 and carries it. The developing roller 24 as an example of a developing member supplies the toner T contained in the developer to the photosensitive drum 14. The blade 25 regulates an amount of the developer carried on the magnetic roller 23.

The housing 20 is formed in a box-like shape elongated in the front-and-rear direction, and made of synthetic resin, for example. At an upper portion of the housing 20, an opening 20A is opened to the photosensitive drum 14. On a bottom face of the housing 20, a first conveying path 26 and a second conveying path 27 separated by a partition wall 20B extending in the front-and-rear direction are formed. FIG. 3 shows conveying directions of the developer in the first conveying path 26 and the second conveying path 27 by void arrows A and B, respectively.

As shown in FIG. 3, the first conveying path 26 and the second conveying path 27 are disposed in parallel each other. At both end portions of the partition wall 20B in the front-and-rear direction, communication paths 28 are formed so as to communicate the first conveying path 26 with the second conveying path 27. The housing 20 has a replenishment port 29 through which the developer is replenished from the toner container 10 to an upstream side portion of the first conveying path 26. The housing 20 has a discharge part 20C through which the excessive developer is discharged to a collection bottle 100. The discharge part 20C is formed to extend the second conveying path 27 in the downstream side. On a lower face of the discharge part 20C, a discharge port (not shown) connected to the collection bottle 100 is opened.

As shown in FIG. 2 and FIG. 3, the first agitating screw 21 is disposed along the first conveying path 26, and the second agitating screw 22 is disposed along the second conveying path 27. The first agitating screw 21 and the second agitating screw 22 respectively include screw shafts 21A and 22A and spiral blades 21B and 22B provided on outer faces of the screw shafts 21A and 22A along the front-and-rear direction (an axis direction). Both front and rear end portions of each of the screw shafts 21A and 22A are supported by the housing 20 so as to be rotatable around the axis. The two spiral blades 21B and 22B have almost the same pitch, and an oppose phase to each other.

As shown in FIG. 3, on a downstream side portion of the screw shaft 22A of the second agitating screw 22, an inverted spiral blade 22C having an oppose phase to the phase of the spiral blade 22B is formed. On a downstream side end of the screw shaft 22A at the downstream side of the inverted spiral blade 22C, a discharge blade 22D having the same phase as the phase of the spiral blade 22B and a small diameter is formed.

As shown in FIG. 2, the magnetic roller 23 is disposed above the second agitating screw 22. The magnetic roller 23 includes a fixed shaft 23A, a magnetic pole member 23B and a rotating sleeve 23C. The fixed shaft 23A is formed in a rod-like shape elongated in the front-and-rear direction, and both ends of the fixed shaft 23A are supported by the housing 20 so as not to be rotatable. The magnetic pole member 23B is a magnet formed in an approximate fan-like shape viewed from the front side, and fixed to the fixed shaft 23A. The rotating sleeve 23C is formed in a cylindrical shape elongated in the front-and-rear direction, and made of non-magnetic material. The rotating sleeve 23C is provided around the magnetic pole member 23B in a rotatable manner around an axis.

The developing roller 24 is disposed above the magnetic roller 23 via a small gap. The developing roller 24 is exposed through the opening 20A of the housing 20 and faces the photosensitive drum 14 via a small gap.

The developing roller 24 includes a developing fixed shaft 24A, a developing magnetic pole member 24B and a developing sleeve 24C. The developing fixed shaft 24A is formed in a rod-like shape elongated in the front-and-rear direction, and both end portions of the developing fixed shaft 24A are supported by the housing 20 so as not to be rotatable. The developing magnetic pole member 24B is fixed to the developing fixed shaft 24A at a position facing the magnetic pole member 23B. The developing magnetic pole member 24B is made of a magnet having a pole different from the magnetic pole member 23B. The developing sleeve 24C is formed in a cylindrical shape elongated in the front-and-rear direction, and made of non-magnetic material. The developing sleeve 24C is provided around the developing magnetic pole member 24B with a gap, and supported by the developing fixed shaft 24A so as to be rotatable around an axis.

The first and second agitating screws 21 and 22 (the screw shafts 21A and 22A), the magnetic roller 23 (the rotating sleeve 23C) and the developing roller 24 (the developing sleeve 24C) are connected to a drive motor (not shown) via a gear train and the others. The magnetic roller 23 and the developing roller 24 are electrically connected to a power source (not shown).

The blade 25 is fixed to a right side portion of the housing 20. The blade 25 is disposed at the upstream side of an opposing area between the magnetic roller 23 and the developing roller 24 in the rotating direction of the magnetic roller 23. A tip end portion of the blade 25 faces an outer circumferential face of the magnetic roller 23 via a small gap.

<An operation of the developing device> An operation (a developing process) of the developing device 16 will be described. The housing 20 is replenished with the developer through the replenishment port 29 from the toner container 10.

The control device 9 controls the developing device 16 to carry out the following developing process. The control device 9 controls the drive motor to rotate the first and second agitating screws 21 and 22, the magnetic roller 23 and the developing roller 24 around their corresponding axes. The control device 9 controls the power source to apply a first bias voltage to the magnetic roller 23 and to apply a second bias voltage to the developing roller 24.

The first agitating screw 21 rotates around the axis to agitate and convey the developer in the first conveying path 26 (refer to an arrow A in FIG. 3). The developer enters the second conveying path 27 through the communication path 28. The second agitating screw 22 rotates around the axis to agitate and convey the developer in the second conveying path 27 (refer to an arrow B in FIG. 3). The developer is conveyed to the downstream end in the second conveying path 27, blocked by the inverted spiral blade 22C and then enters the first conveying path 26 again through the communication path 28. That is, the developer circulates between the first conveying path 26 and the second conveying path 27. Then, the toner T is charged to a predetermined level and carried by the carrier.

The developer is drawn up and carried on the magnetic roller 23 to form a magnetic brash (not shown). The blade 25 regulates a thickness of the magnetic brash on the rotating magnetic roller 23. The magnetic roller 23 rotates around the axis and supplies the toner T contained in the developer to the developing roller 24 at the position facing the developing roller 24. In detail, the toner T moves to the developing roller 24 by a potential difference between the first bias voltage applied to the magnetic roller 23 and the second bias voltage applied to the developing roller 24 and the magnetic field. Then, a layer of the toner T is formed on the developing roller 24.

The developing roller 24 (the development sleeve 24C) rotates around the axis and supplies the toner T to the photosensitive drum 14 at the position facing the photosensitive drum 14. In detail, the toner T flies from the developing roller 24 to the photosensitive drum 14 by a potential difference between the developing roller 24 and the photosensitive drum 14. Then, the electrostatic latent image on the photosensitive drum 14 is developed to the toner image.

The remained toner T which is not subjected to the developing is conveyed by the rotating developing roller 24 to the portion facing the magnetic roller 23, and collected to the magnetic brush on the magnetic roller 23. The magnetic brush is removed from the magnetic roller 23 at the same pole portion of the magnetic pole member 23B, and then fallen in the second conveying path 27.

The control device 9 carries out an operation to replenish the housing 20 with the developer from the toner container 10 on the basis of a detection result of a concentration sensor (not shown). The excessive developer in the housing 20 is conveyed over the inverted spiral blade 22C to the discharge port by the discharge blade 22D, and then discharged through the discharge port to the collection bottle 100.

By the way, with a speed-up of the image forming process, the magnetic roller 23, the developing roller 24 and the others rotate at a high speed. Thereby, the toner T is sometimes scattered from the rollers 23 and 24, and then accumulated on a portion under the developing roller 24 (refer to FIG. 2). In detail, the casing 20 includes a toner receiving face F inclined downward from the opening 20A to the blade 25 under the developing roller 24. The toner T is accumulated on the toner receiving face F. When the accumulation of the toner T on the toner receiving face F is proceeded, the accumulated toner T may be scattered inside the apparatus main body 2 through the opening 20A from the housing 20. Then, in the color printer 1 of the present embodiment, the scattering prevention structure 30 prevents the toner T from being accumulated so as to reduce an amount of the scattered toner.

Figure 4:
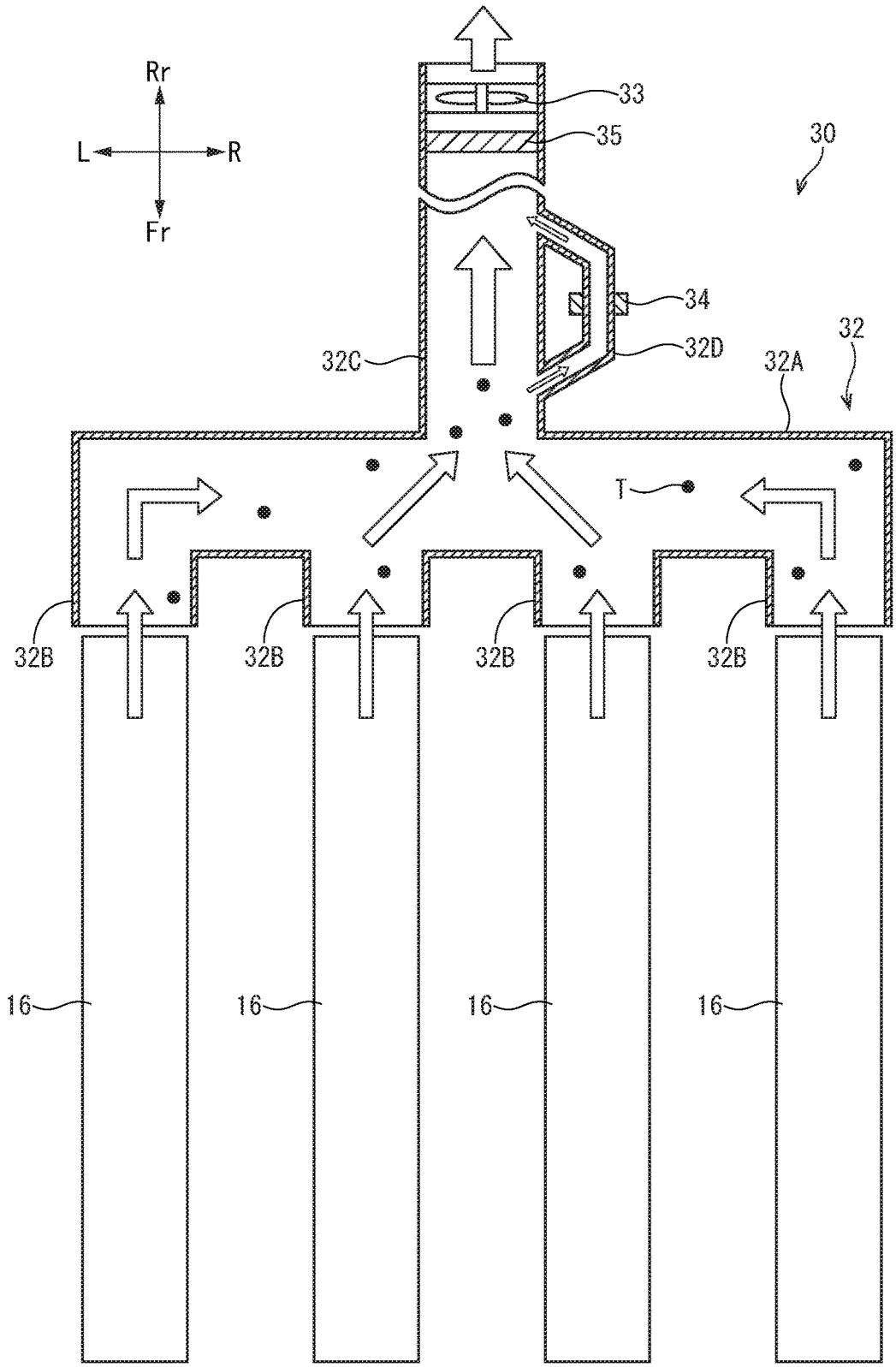
FIG. 4 is a sectional view schematically showing a scattering prevention structure and the others according to one embodiment of the present disclosure.
Figure 5:
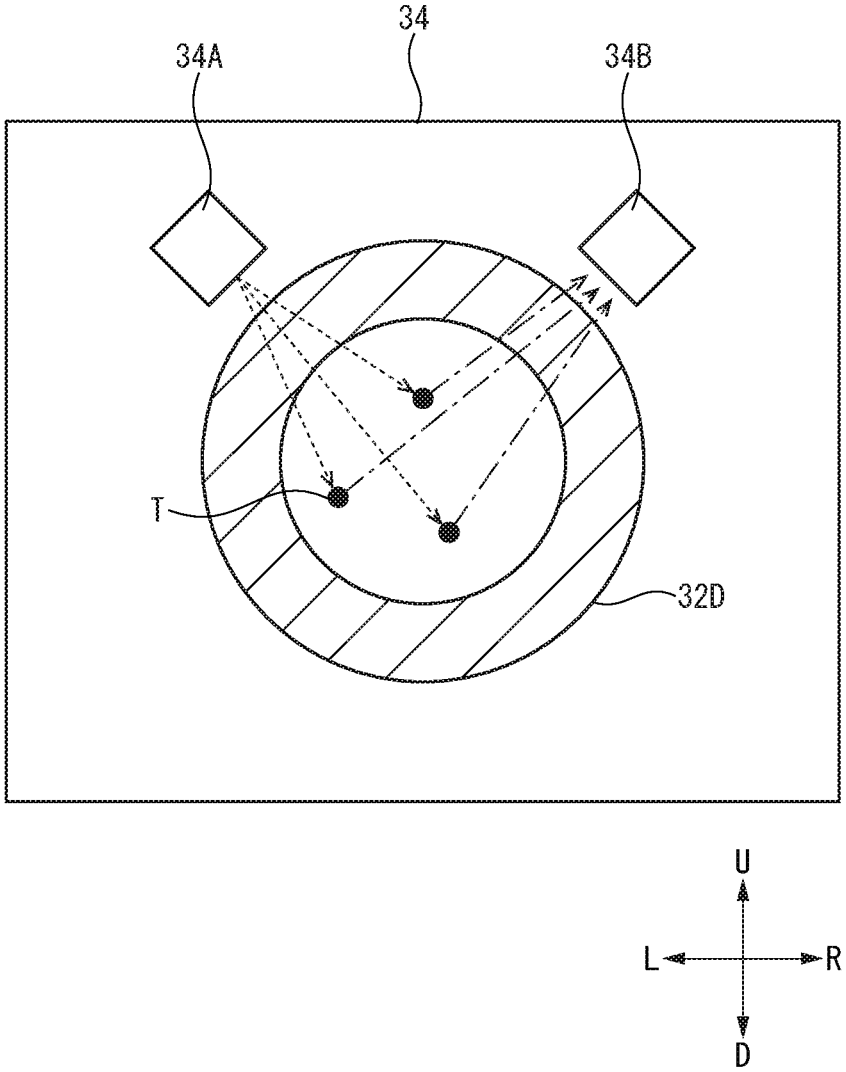
FIG. 5 is a sectional view schematically showing a detecting device and the others according to one embodiment of the present disclosure.
Figure 6:
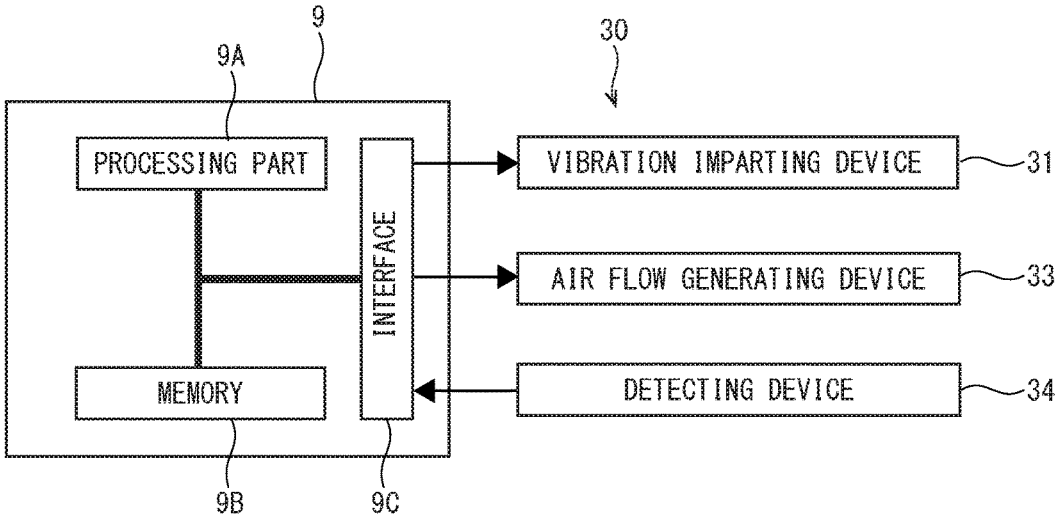
FIG. 6 is a block diagram showing a control device and the others of the color printer according to one embodiment of the present invention.

<The scattering prevention structure> With reference to FIG. 2, FIG. 4 to FIG. 6, the scattering prevention structure 30 will be described. FIG. 4 is a sectional view schematically showing the scattering prevention structure 30 and the others. FIG. 5 is a sectional view schematically showing a detecting device 34 and the others. FIG. 6 is a block diagram showing the control device 9 and the others.

As shown in FIG. 2 and FIG. 4, the scattering prevention structure 30 includes a vibration imparting device 31, a toner duct 32, an air flow generating device 33 and a detecting device 34. The vibration imparting device 31 is a device configured to impart vibration to the toner T accumulated under the developing roller 24. The toner duct 32 is a duct through which the scattered toner T is passed. The air flow generating device 33 is a device configured to generate air flow toward the toner duct 32. The detecting device 34 is a device configured to calculate a number of the toner T scattered to the outside from the inside of the developing device 16. In the specification, "an upstream", "a downstream" and terms sillier to these respectively show "an upstream", "a downstream" and concept similar to these in an air flow direction.

<The vibration imparting device> As shown in FIG. 2, the vibration imparting device 31 includes a plurality of vibration motors (not shown) fixed to an outer face of the housing 20 at a position corresponding to the toner receiving face F. Each vibration motor is a motor in which an output shaft to which a vibrator is attached is rotated to generate vibration. The plurality of vibration motors are disposed at almost the same interval in the front-and-rear direction.

<The toner duct> As shown in FIG. 4, the toner duct 32 is disposed on the rear side of the four developing devices 16. The toner duct 32 includes a duct main body 32A, four inflow ducts 32B and an outflow duct 32C. The duct main body 32A is formed in an approximate rectangular cylindrical shape elongated in the left-and-right direction. The duct main body 32A has a length across the four developing devices 16 arranged in the left-and-right direction. The four inflow ducts 32B extend from the duct main body 32A towards the four developing devices 16 (forward). A tip face of each inflow duct 32B is opened to each developing device 16. The outflow duct 32C extends from the duct main body 32B rearward. That is, the outflow ducts 32C extends in a direction opposing to the inflow ducts 32B. A tip face of the outflow duct 32C is connected to a rear face of the apparatus main body 2 and opened to the open air. At a downstream end portion of the outflow duct 32C, a dust collection filter 35 which collects the toner T is provided. A pre-filter (not shown) which collects dust larger than the toner T may be provided at the upstream side of the dust collection filter 35.

<The air flow generating device> The air flow generating device 33 is provided at the downstream side of the dust collection filter 35 in the outflow duct 32C. The air flow generating device 33 is a suction fan including a motor which rotates a propeller around an axis. The air flow generating device 33 sucks in air in the apparatus main body 2 (near the developing device 16) through the four inflow ducts 32B into the duct main body 32A, and discharges the sucked air in the duct main body 32A through the outflow duct 32C to the open air (refer to void arrows in FIG. 4).

<The detecting device> The detecting device 34 is provided on a middle of a branch duct 32D branched from the outflow duct 32C. The detecting device 34 detects the toner T passing through the branch duct 32D (the toner duct 32). The branch duct 32D is branched at the upstream side portion of the outflow duct 32C and joined at the downstream side portion of the outflow duct 32C. The branch duct 32D is provided at the upstream side of the dust collection filter 35.

As shown in FIG. 5, the detecting device 34 is a light dispersing type particle counter countable a number of the toner particle. The detecting device 34 includes a light emitting part 34A and a light receiving part 34B. The light emitting part 34A includes a light emitting diode, a lens and the others, and emits laser light to the scattered toner T (the toner T flowing through the branch duct 32D) (refer to broken line arrows in FIG. 5). The light receiving part 34B includes a photo transistor, a condensing lens and the others, and receives the laser light scattered on the scattered toner T (refer to single dashed chain line arrows in FIG. 5) and inverts an amount of the received light receiving to an electrical signal.

<The control device> The vibration imparting device 31, the air flow generating device 33 and the detecting device 34 are electrically connected to the control device 9 and controlled by the control device 9. As shown in FIG. 6, the control device 9 includes a processing part 9A, a memory 9B and an interface 9C.

The processing part 9A executes an operational processing on the basis of a program or the like. The memory 9B stores the program and date used for various controls. The memory 9B sometimes stores an operational result obtained by the processing part 9A. The above devices 31, 33 and 34 are connected to the control device 9 via the interface 9C.

As described below, the above vibration imparting device 31 is configured to vibrate and crash the toner T accumulated on the toner receiving face F (refer to FIG. 2). However, when the vibration imparting device 31 is operated, it is required to stop the image forming operation (the transferring the toner image to the sheet S). For example, when the vibration imparting device 31 is periodically operated, a control to elongate a conveying interval of the sheet S is required, and usability and workability for a user may be therefore deteriorated. Thereby, in view of the usability and workability for a user, a timing when the vibration imparting device 31 is operated is important. For example, the vibration imparting device 31 is preferably operated by judging an accumulated state of the toner T on the toner receiving face F. Then, the control device 9 estimates the accumulated state of the toner T on the toner receiving face F on the basis of the detecting result of the detecting device 34, and then controls the vibration imparting device 31.

Figure 7:
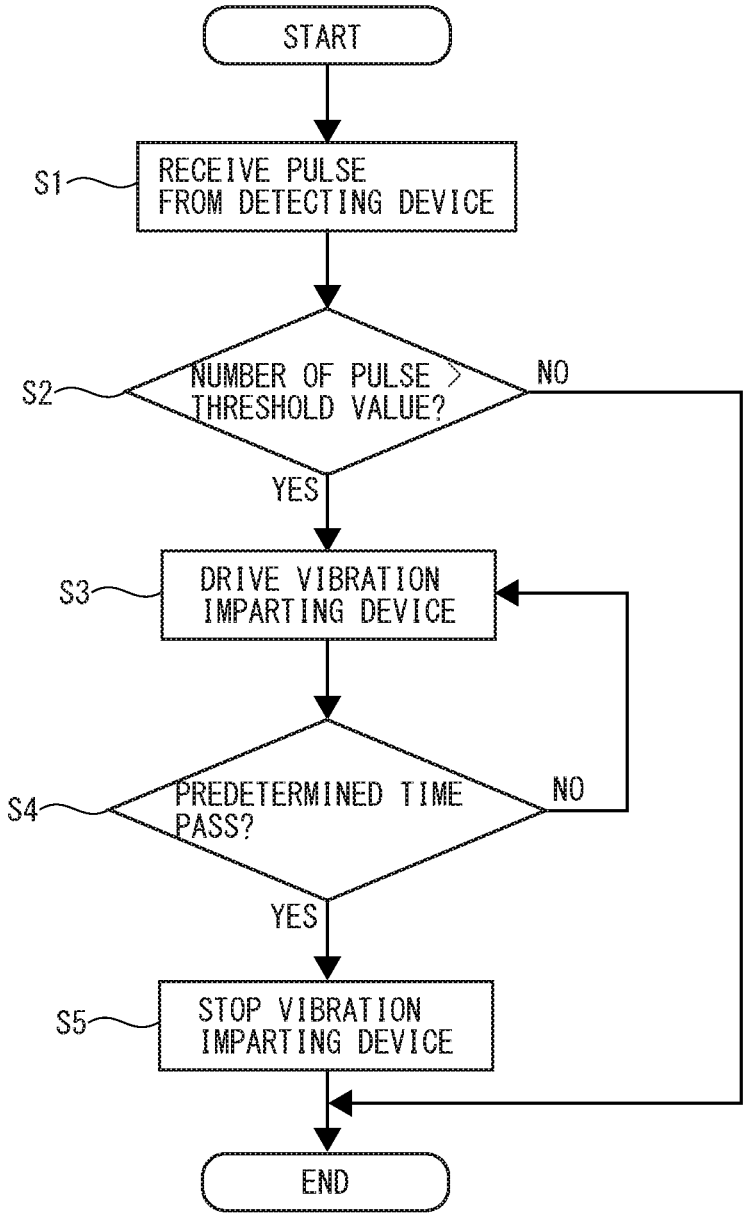
FIG. 7 is a flow chart showing a toner accumulation prevention process of the scattering prevention structure according to one embodiment of the present invention.
Figure 8:
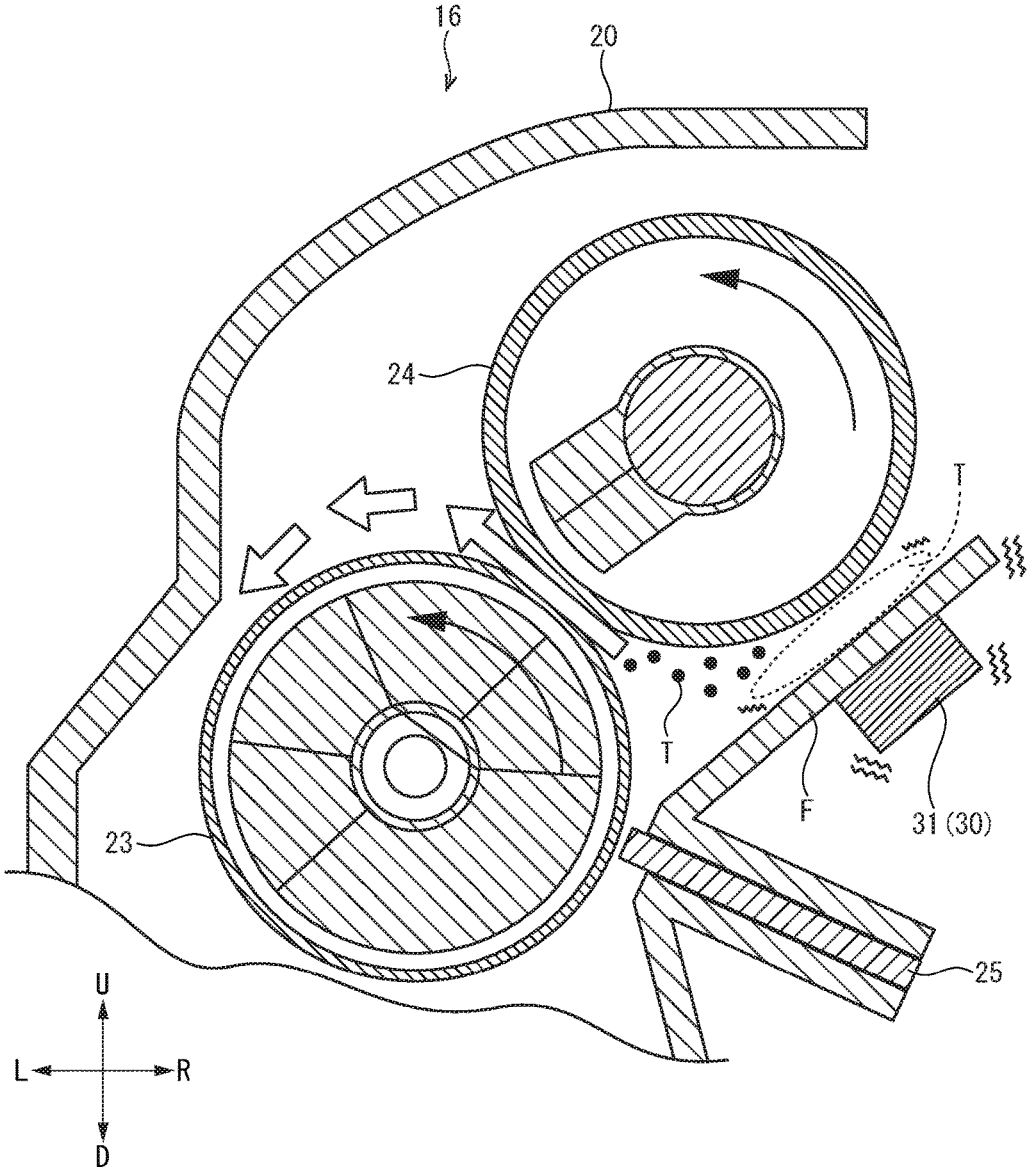
FIG. 8 is a sectional view schematically showing a part of the developing device according to one embodiment of the present invention.

<An operation of the scattering prevention structure> With reference to FIG. 4, FIG. 7 and FIG. 8, the operation of the scattering prevention structure 30 (a process to prevent the accumulation of the toner T) will be described. FIG. 7 is a flowchart showing the process to prevent the accumulation of the toner T by the scattering prevention structure 30. FIG. 8 is a sectional view schematically showing a part of the developing device 16.

As shown in FIG. 4, the air flow generating device 33 is controlled by the control device 9 to generate the air flow from the front side to the rear side of each developing device 16. The toner T (hereinafter, also called as the scattered toner T) scattered from each developing device 16 (the toner receiving face F) is conveyed with the air flow, and enters the duct main body 32A through each inflow duct 32B. Then, the scattered toner T enters the outflow duct 32C and the branch duct 32C from the duct main body 32A. The scattered toner T flowing through the outflow duct 32C is collected by the dust collection filter 35, and the air from which the scattered toner T is removed is discharged to the outside of the apparatus main body 2. On the other hand, a number of the scattered toner T flowing through the branch duct 32D is counted by the detecting device 34.

The detecting device 34 sends a pulse (an electrical signal) corresponding to the number of the scattered toner T flowing through the branch duct 32D to the control device 9. As shown in FIG. 7, the control device 9 (the processing part 9A) receives the pulse send from the detecting device 34, and stores it in the memory 9B temporarily (step 1). The control device 9 decides the number of the scattered toner T from the received pulse. In detail, the control device 9 identifies a wave height showing the toner particle from the received pulse, and recognizes the number of the scattered toner T from the number of the pulse showing the toner particle. The control device 9 decides whether the number of the scattered toner T exceeds a threshold value (a predetermined condition) or not (step S2). The threshold value is set to a value (a number of the scattered toner T per unit time) which causes an image defect by contamination of the inside of the apparatus main body 2 with the scattered toner T. The threshold value is experimentally and empirically obtained and stored in the memory 9B of the control device 9 previously.

When the number of the scattered toner T (the pulse) is smaller than the threshold value (NO at step S2), the control device 9 judges that the toner T is not accumulated on the toner receiving face F, and the control is finished. On the other hand, when the control device 9 judges that the number of the scattered toner T exceeds the threshold value (YES at step S2), the control device 9 controls the vibration imparting device 31 so as to impart the vibration to the toner received face F (step S3). At this time, although the magnetic roller 23 and the developing roller 24 (the drive motor) are driven, the charging and exposing of the photosensitive drum 14 and the primary transferring for the intermediate transferring belt 11 are not carried out.

As shown in FIG. 8, the vibration imparting device 9 is controlled by the control device 9 to vibrate the toner receiving face F on which the toner T is accumulated. That is, the vibration imparting device 31 imparts the vibration to the toner T accumulated on the toner receiving face F. Then, the toner T accumulated on the toner receiving face F is crushed by the vibration, and moves to the side of the magnetic roller 23 with air flow generated by rotation of the magnetic roller 23 and the others (refer to void arrows in FIG. 8). Then, the toner T is collected by the magnetic brush on the magnetic roller 23, removed from the magnetic roller 23 and then fallen into the second conveying path 27.

Thereby, it becomes possible to prevent the amount of the toner T accumulated on the toner receiving face F from being increased.

As shown in FIG. 7, the control device 9 continues to drive the vibration imparting device 31 until a predetermined time passes (NO at step 4). After the predetermined time passes (YES at step S4), the control device 9 stops to drive the vibration imparting device 31 (step S5), and the control is finished. The control device 9 repeatedly executes the above steps S1 to S5 at a predetermined time interval. The predetermined time for driving the vibration imparting device 31 and the predetermined time interval for repeatedly executing the steps S1 to S5 are previously set and stored in the memory 9B.

As described above, the color printer 1 according to the present embodiment is configured such that when the number of the toner T detected by the detecting device 34 satisfies a predetermined condition, the vibration imparting device 31 imparts the vibration to the toner T accumulated on the toner receiving face F. That is, when the detecting device 34 detects increasing of the amount of the scattered toner T, it is estimated that the amount of the accumulated toner T may be increased, and then the vibration imparting device 31 vibrates and crushes the accumulated toner T. According to the configuration, it becomes possible to drive the vibration imparting device 31 at a more suitable timing compared with a case where the vibration imparting device 31 is periodically driven. Therefore, it becomes possible to control the timing when the image forming processing is stopped and to suppress the deterioration of the usability for a user as small as possible. Furthermore, according to the configuration, it becomes possible to suppress the toner T from being accumulated in the developing device 16. Accordingly, it becomes possible to prevent generation of the scattered toner T so that the amount of the scattered toner T can be decreased.

According to the color printer 1 of the present embodiment, the detecting device 34 can detect the number of the scattered toner T flowing through the toner duct 32 (the branch duct 32D). Accordingly, the detecting device 34 can detect the number of the scattered toner T stably compared with a case where the toner T floating in the air is detected.

According to the color printer 1 of the present embodiment, since the detecting device 34 is constituted by the light dispersing type particle counter, it becomes possible to detect the number of the scattered toner T easily and precisely. Furthermore, as the result of vibrating the toner receiving face F by the vibration imparting device 31, the accumulated toner T can be returned in the housing 20.

In the color printer 1 of the present embodiment, although the vibration imparting device 3 includes a plurality of motors, the present disclosure is not limited to the embodiment. For example, in another embodiment, the vibration imparting device may include a plurality of cams or projections (not shown) rotating around an eccentric shaft. In this case, each cam or projection rotates around the eccentric shaft to strike the wall of the housing 20 and to vibrate the toner receiving face F.

In the color printer 1 of the present embodiment, although the air flow generating device 33 is constructed by the suction fan, the present disclosure is not limited to the embodiment. In another embodiment, the air flow generating device may be a blower fan disposed at the upstream side in the air flow direction and flowing air to the downstream side.

In the color printer 1 of the present embodiment, although the control device 9 executes the image forming process and the toner accumulation suppressing process, the present disclosure is not limited to the embodiment. For example, a sub control device cooperated with the control device 9 is separately provided to control the scattering prevention structure 30. Furthermore, although the vibration imparting device 31 is driven when the number of the scattered toner T exceeds the threshold value, the present disclosure is not limited to the embodiment. In another embodiment, when the number of the scattered toner T is larger than the threshold value, the vibration imparting device 31 may be driven.

While the above description has been described with reference to the particular illustrative embodiments of the image forming apparatus according to the present disclosure, a technical range of the disclosure is not to be restricted by the description and illustration of the embodiment.

The invention claimed is:

1. An image forming apparatus comprising:

an image carrier rotating around an axis;

a developing device including a developing member rotating around an axis at a position facing the image carrier and supplying a toner to the image carrier;

a toner duct through which the toner scattered from an inside to an outside of the developing device is passed;

a detecting device detecting a number of the toner passing through the toner duct;

a dust collection filter collecting the toner passed through the toner duct;

a vibration imparting device which imparts vibration to the toner accumulated near the developing member; and a control device to drive the vibration imparting device when the number of the toner detected by the detecting device satisfies a predetermined condition.

2. The image forming apparatus according to claim 1, wherein the toner duct includes:

an outflow duct extending toward an outside of an apparatus main body in which the developing device is stored; and a branch duct provided at a middle of the outflow duct, wherein the detecting device detects the number of the toner passing through the branch duct.

3. The image forming apparatus according to claim 1, wherein the control device drives the vibration imparting device when the number of the toner detected by the detecting device per unit time reaches a number which causes an image defect due to contamination with the scattered toner.

4. The image forming apparatus according to claim 1, wherein the detecting device includes:

a light emitting part emitting laser light on the scattered toner; and a light receiving part receiving the laser light scattered on the scattered toner and inverting an amount of the received light to an electrical signal, wherein the control device decides the number of the scattered toner by the electrical signal.

5. The image forming apparatus according to claim 1, wherein the developing device includes:

a housing in which a developer containing the toner is stored;

a magnetic member rotating around an axis at a position facing the developing member under the developing member and supplying the toner contained in the developer stored in the housing to the developing member; and a blade regulating an amount of the developer carried on the magnetic member, wherein the housing has a toner receiving face which is inclined downward to the blade from an opening opened to the image carrier and disposed under the developing member, and the vibration imparting device imparts the vibration to the toner receiving face on which the toner is accumulated.

6. The image forming apparatus according to claim 5, wherein the vibration imparting device imparts the vibration to the toner receiving face, crashes the toner accumulated on the toner receiving face and then the crashed toner is collected by the magnetic member.

* * * * *